US006675709B2

(12) United States Patent
Corti et al.

(10) Patent No.: US 6,675,709 B2
(45) Date of Patent: Jan. 13, 2004

(54) BAR FOR SUPPLYING FLUID DETERGENT MIXTURE IN EQUIPMENT FOR THE AUTOMATIC CLEANING OF PRINTING MACHINE CYLINDERS

(76) Inventors: Marco Corti, Via Fornaci 16, I-23900 Lecco (IT); Riccardo Fumagalli, Via Baravico 41, I-23848 Oggiono (IT)

( * ) Notice: Subject to any disclaimer, the term of this patent is extended or adjusted under 35 U.S.C. 154(b) by 0 days.

(21) Appl. No.: 09/958,874

(22) PCT Filed: Jan. 11, 2001

(86) PCT No.: PCT/EP01/00267

§ 371 (c)(1),
(2), (4) Date: Oct. 17, 2001

(87) PCT Pub. No.: WO01/62497

PCT Pub. Date: Aug. 30, 2001

(65) Prior Publication Data

US 2002/0152908 A1 Oct. 24, 2002

(30) Foreign Application Priority Data

Feb. 25, 2000 (IT) ..... BO2000A0090

(51) Int. Cl.[7] ..... B41F 35/00
(52) U.S. Cl. ..... 101/424; 101/425
(58) Field of Search ..... 101/424, 425, 101/423; 134/153, 151

(56) References Cited

U.S. PATENT DOCUMENTS 3,355,324 A * 11/1967 Catzen ..... 134/29
4,540,445 A * 9/1985 Burns, Jr. ..... 134/21
5,836,250 A * 11/1998 Herrmann et al. ..... 101/483
6,347,587 B2 * 2/2002 Ghisalberti et al. ..... 101/424

* cited by examiner

*Primary Examiner*—Anthony H. Nguyen
(74) *Attorney, Agent, or Firm*—Larson & Taylor PLC

(57) ABSTRACT

At least one restriction (R) of the terminal part of the fluid mixture delivery channel (20) is introduced upstream of each bifurcation (B), preferably at the branching point of the said bifurcation, this restriction having the function of recompacting the said mixture on the mid-line of the said bifurcation, in such a way that the distribution of the said mixture can be carried out in an equal way in the two following channels. The aforesaid restriction also has the function of progressively calibrating the pressures in the fluid mixture transport circuits, in such a way that identical quantities and qualities of mixture reach the various outlet holes (10), even when the transport channels (1000) are made with sufficiently large dimensions to ensure that the quantity of air required for effective spraying of the transported detergent liquid reaches the final outlet holes (10).

23 Claims, 7 Drawing Sheets

BAR FOR SUPPLYING FLUID DETERGENT MIXTURE IN EQUIPMENT FOR THE AUTOMATIC CLEANING OF PRINTING MACHINE CYLINDERS

DESCRIPTION

During the production and use of equipment for the automatic cleaning of inking rollers and rubber-coated cylinders of printing machines, described in Italian Patent No. 1,286,206 (or equivalent EP 0 916 492), it was found to be useful to make certain important modifications to improve the operation of the means of supplying the fluid mixture for cleaning the said rollers and cylinders, and in particular to provide a uniform distribution to the different supply holes of the said mixture formed from pressurized air and liquid, with small percentages of the liquid dispersed in the air which acts as the means of transport. For a clearer understanding of the objects of the invention, it will be useful to recall the prior art described in the patent cited above, with reference to FIG. 1 of the attached drawings, which shows a cross section of the fluid mixture supply bar, and with reference to FIGS. 2 and 2*a* which show, in a plan view from above and divided into two parts, with the division along the mid-line, the bar of FIG. 1 with the channels which distribute the cleaning fluid mixture to the various supply nozzles of the bar. The equipment which is referred to (FIG. 1) comprises a bar 1 of light alloy, parallel to, and located at a short distance from, each rubber-coated cylinder 2, and having on its side facing the cylinder a longitudinal rectilinear recess 3 in which a presser 4 with an elastic and yielding membrane 5 is guided. The said bar 1 houses the pneumatic actuators 6 which on command push the presser 4, 5 against the cylinder 2, to bring into contact with the cylinder the interposed cloth 7 on which a cleaning fluid has been previously sprayed by means of nozzles 9 mounted in one or more seats 8 formed in the said side of the bar which faces the cloth, these nozzles being connected, by means of holes 10, to channels 1000 formed by milling in a flat side of the said bar, over which a flat seal 12 is subsequently extended and a cover plate 13 is fixed with screws 14 to convert the said channels into ducts. These channels are connected symmetrically to other supply channels branching from each other, which are bifurcated and progressively reduced in number, until they meet a single fluid mixture supply duct 100, connected to an aperture 15 at one end of the bar 1 (see also FIGS. 2, 2*a*). Each bifurcation of the said channels is essentially Y-shaped and is formed as part of a rectilinear path, and the channels resulting from the bifurcation are structured in such a way as to offer an essentially equal resistance to the passage of the fluid mixture, so that this fluid is divided into essentially equal quantities in each bifurcation. The number of bifurcations is such that each final channel resulting from a bifurcation supplies a single nozzle, in such a way as to provide a balanced distribution of the cleaning fluid mixture between the various nozzles of the equipment. FIGS. 2 and 2*a* also show that the aperture 15 communicates through the perpendicular hole 16 with a first channel 100 formed longitudinally in the bar 1 and that this channel is subjected, before the mid-line 18 of the bar, to a bifurcation B1 which gives rise to two rectilinear and opposing ducts 101, 201 which, before reaching the half-way point of each half bar, are subjected to respective bifurcations B2, B3 which give rise to respective pairs of ducts, aligned with and identical to each other, 102, 202 and 103, 203, which are then subjected to respective bifurcations B4, 85 and B6, B7 which give rise to pairs of ducts 104, 204, 105, 205 and 106, 206, 107, 207 which then undergo respective and final bifurcations B8, B9, B10, B11 and B12, 813, 814, B15 which, by means of their respective channels 108, 208, 109, 209, 110, 210, 111, 211, 112, 212, 113, 213, 114, 214, 115, 215, supply the holes 10 to which respective nozzles 9 are connected. Each channel is followed by two initially rectilinear channels, which are located a short distance apart from each other, are parallel, and are equidistant from the upstream channel. The common dividing wall by which the channels resulting from each bifurcation are connected to the upstream channel is V-shaped in plan and has a sharp point. The two branches following each bifurcation open and proceed in opposite directions, one along an S-shaped path and one along a U-shaped path, as shown in the attached drawings. The number 26 indicates rectilinear milled grooves formed in the base of the channel 11 containing the cleaning liquid transport channels, blind threaded holes being formed in these milled grooves for interaction with the screws 14 for securing the cover assembly 12, 13 which completes the said channels according to the prior art (FIG. 1).

To balance the pressure drops, the channels resulting from each bifurcation are made with a suitable depth and width, as shown in FIG. 1. For example, in the bar made by the applicant and illustrated in FIGS. 2 and 2*a,* provided with sixteen supply nozzles, the initial channel 100 has a depth of approximately 10 mm and a width of approximately 5 mm, while the branches of the final bifurcations have a width of approximately 3 mm and a depth of approximately 2.5 mm. In the same bar, shown in FIGS. 2 and 2*a,* the initial ducts have, for example, a width of 4 mm and a depth of 8 mm. After the first bifurcation, the width changes to 3 mm and the depth to 6 mm. After the next bifurcation, the depth remains constant and the width decreases to 2 mm. The final bifurcation has branches 2.5 mm deep and this depth and the width of 2 mm remain unchanged up to the end.

In the bar in question, the cleaning liquid is injected in a low proportion in a flow of pressurized air which has the function of transporting the liquid and by means of which the liquid is supplied to the aperture 15 of the bar. FIGS. 2 and 2*a* clearly show that the cleaning fluid mixture transport circuit has many curves. The low concentration of the cleaning fluid in the transporting air flow has the effect of making the mixture of air and liquid tend to break up and lose its homogeneity during its passage around each curve of the said circuit, as a result of the centrifugal force, gravity, and especially the contact with the walls of the ducts, on which the liquid tends to be deposited.

At the exit from each curve of the mixture transport duct, it is possible for the quantity of liquid deposited on one lateral wall of the duct to be very different from that deposited on the opposite lateral wall. If the rectilinear duct which follows the curve has a limited length, the mixture of air and liquid cannot be re-compacted and made uniform before it reaches the next bifurcation, and therefore the division of the mixture into the two channels of the said bifurcation may take place incorrectly, in the sense that more liquid than air, or vice versa, may reach one channel.

This disadvantage can be particularly marked in the final bifurcations of the circuit shown in FIGS. 2, 2*a,* for example those indicated by B9, B10 and B13, B14, since the cross section of the channels of the circuit decreases progressively towards the end, for example down to the aforesaid value of 2×2.5 mm. Although the progressive reduction of the section of the channels enables the mixture to be concentrated towards the centre of the channels so that it can be branched in equal portions in the next bifurcations, it also introduces considerable pressure drops into the circuit, and these progressively limit the quantity of air reaching the nozzles, with a negative effect on the desired uniformity of spraying of the mixture by all the nozzles of the bar.

To this disadvantage must be added the fact that the limited cross section of the final channels of the circuit can be decreased incidentally by the deformation of the elastomeric seal 12, under the pressure of the plate 13, in these channels.

The invention is intended to overcome these and other disadvantages of the known art with the following idea for a solution. Upstream from each bifurcation, preferably at the branching point of the bifurcation, a localized restriction which is symmetrical in plan is introduced, and this has the function of compacting the mixture on the mid-line of the point of the said bifurcation, in such a way that the mixture can be distributed equally in the two following channels. The use of the said restrictions makes it possible to form the transport channels 1000 of the bar with sections which can differ only slightly from the start to the end, thus limiting the loss of flow of the whole circuit, while these restrictions, by the progressive decrease of their size from the start to the end, also have the effect of progressively increasing the pressures in the mixture transport circuit, so that a mixture formed from the same quantity of liquid and air reaches the various outlet nozzles 10 in a quantity and at a pressure sufficient to ensure the perfect spraying of the liquid.

These and other characteristics of the invention and the advantages derived therefrom will be more clearly understood from the following description of a preferred embodiment of the invention, illustrated purely by way of example and without restriction in the figures of the attached sheets of drawing in which:

FIGS. 1, 2 and 2*a* show the prior art discussed above;

FIG. 3 shows an enlarged plan view of one of the improved bifurcations of the cleaning mixture transport circuit;

FIGS. 3*a*, 3*b*, 3*c* and 3*d* show four variants of the solution of FIG. 3;

Figure 4:
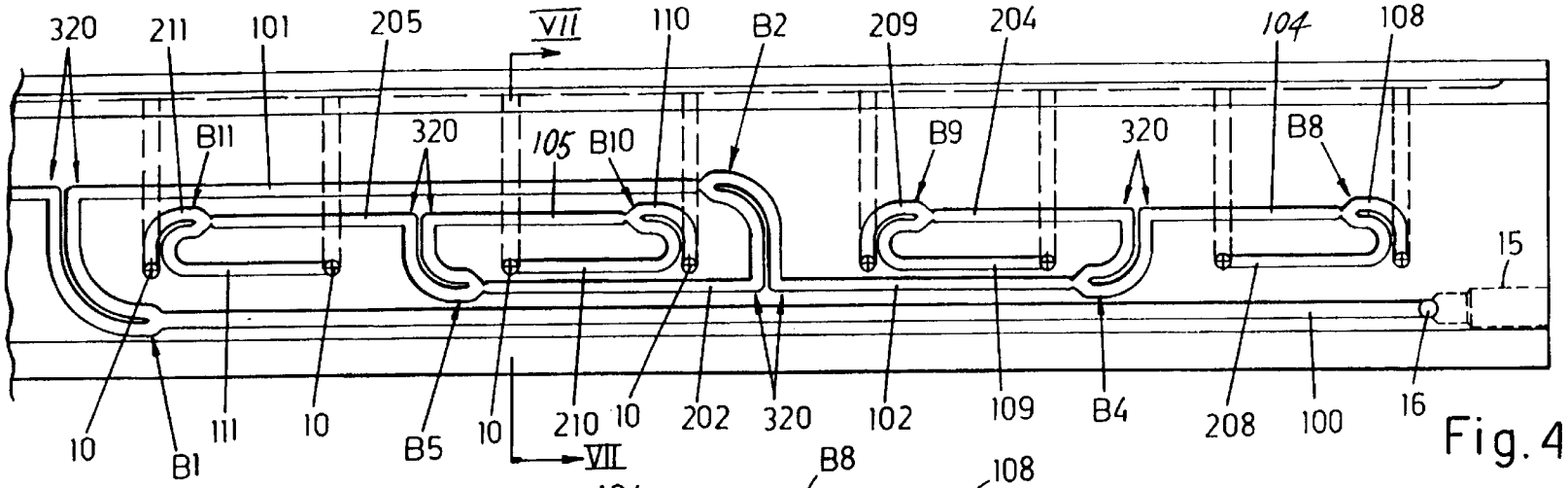
FIG. 4 shows a plan view of the cleaning fluid mixture transport channels in half of a bar for supplying the mixture.
Figure 5A:
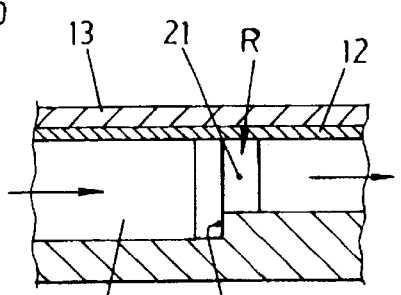
FIG. 5 shows schematically and in a plan view the transport circuit of the bar of FIG. 4, with a possible design of the restrictions introduced into this circuit.
Figure 5:
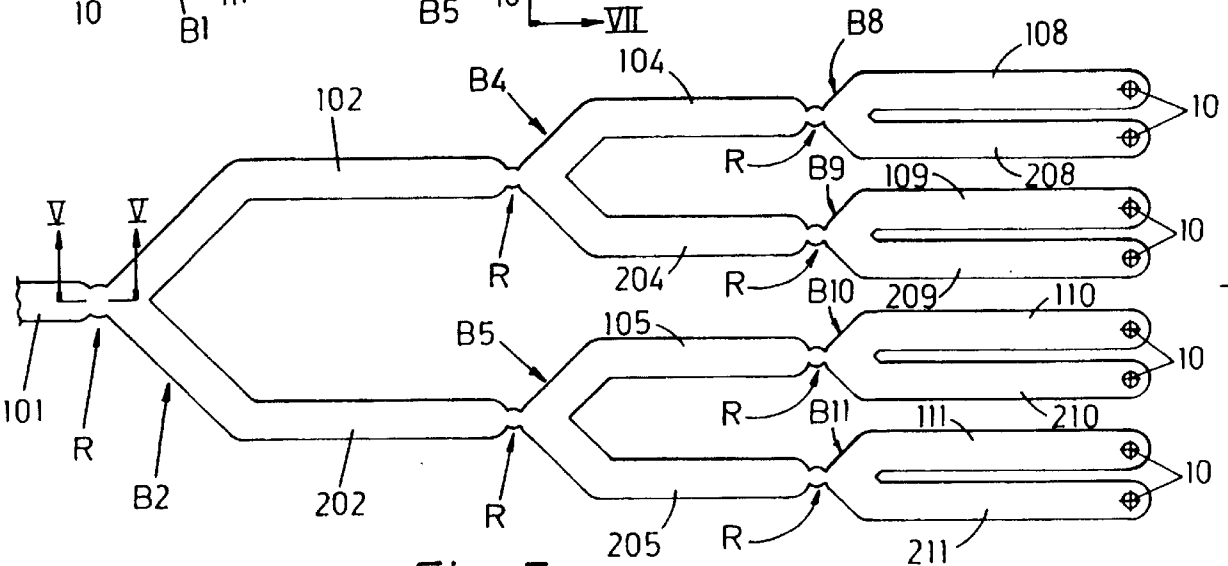
Figure 6A:
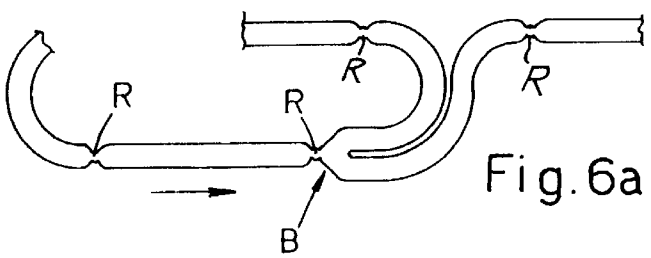
Figure 6C:
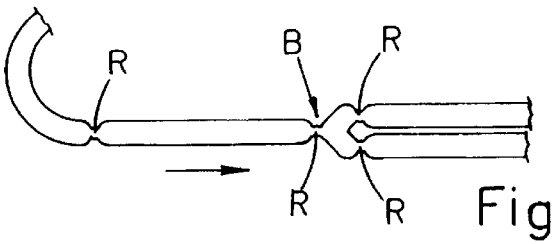
Figure 6F:
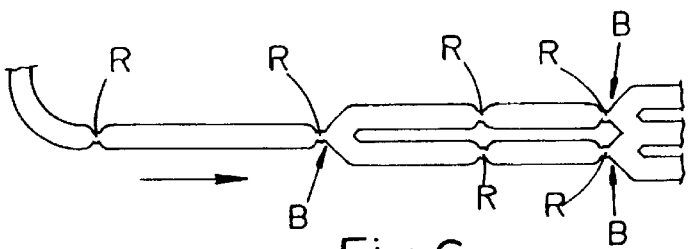
Figure 6E:
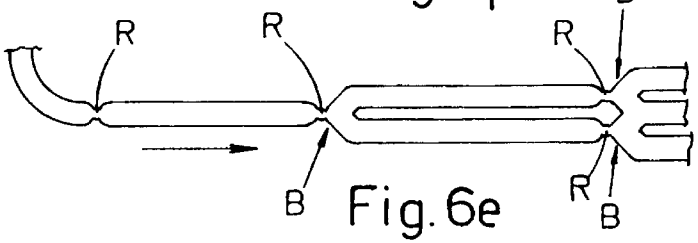
Figure 6B:
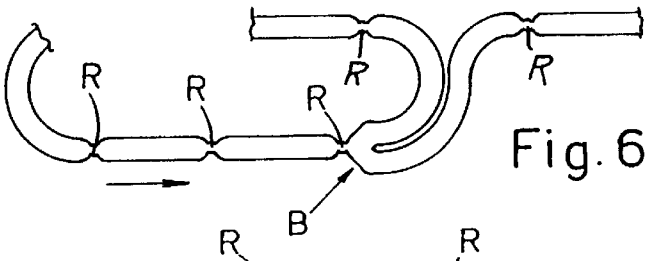
Figure 6D:
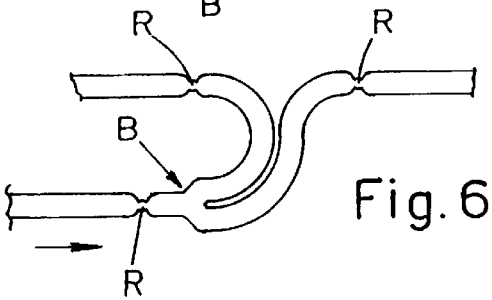
Figure 6H:
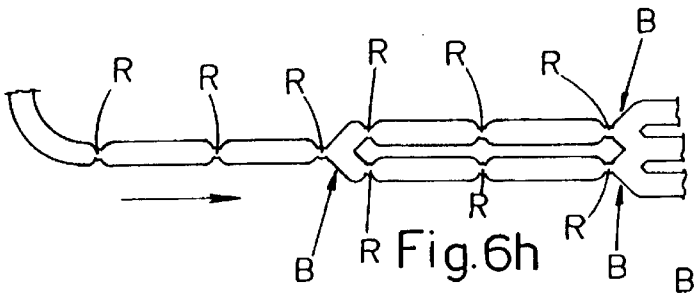
Figure 6G:
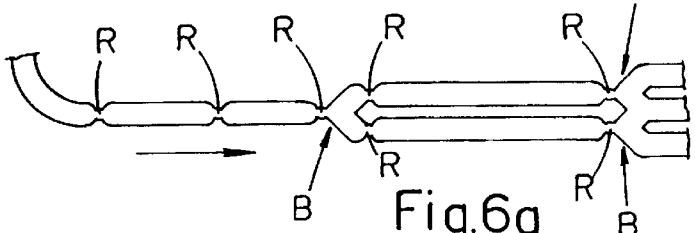
Figure 8:
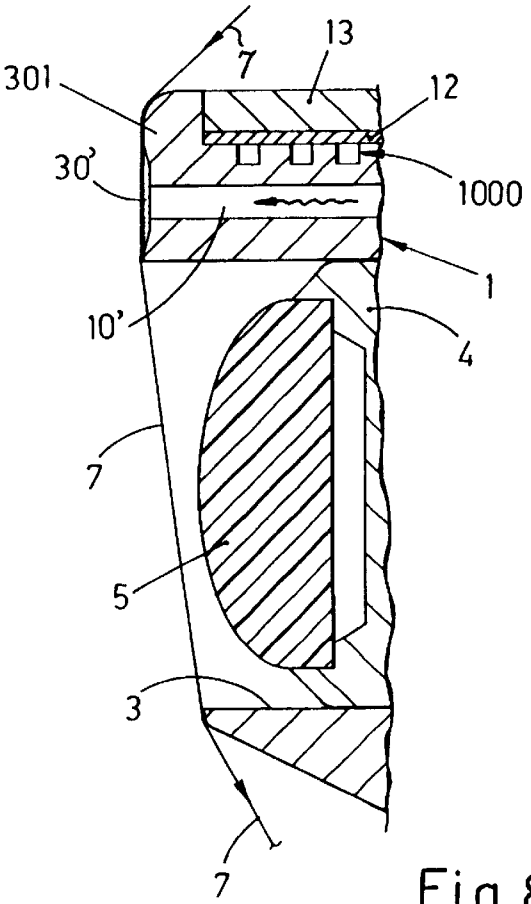
Figure 7:
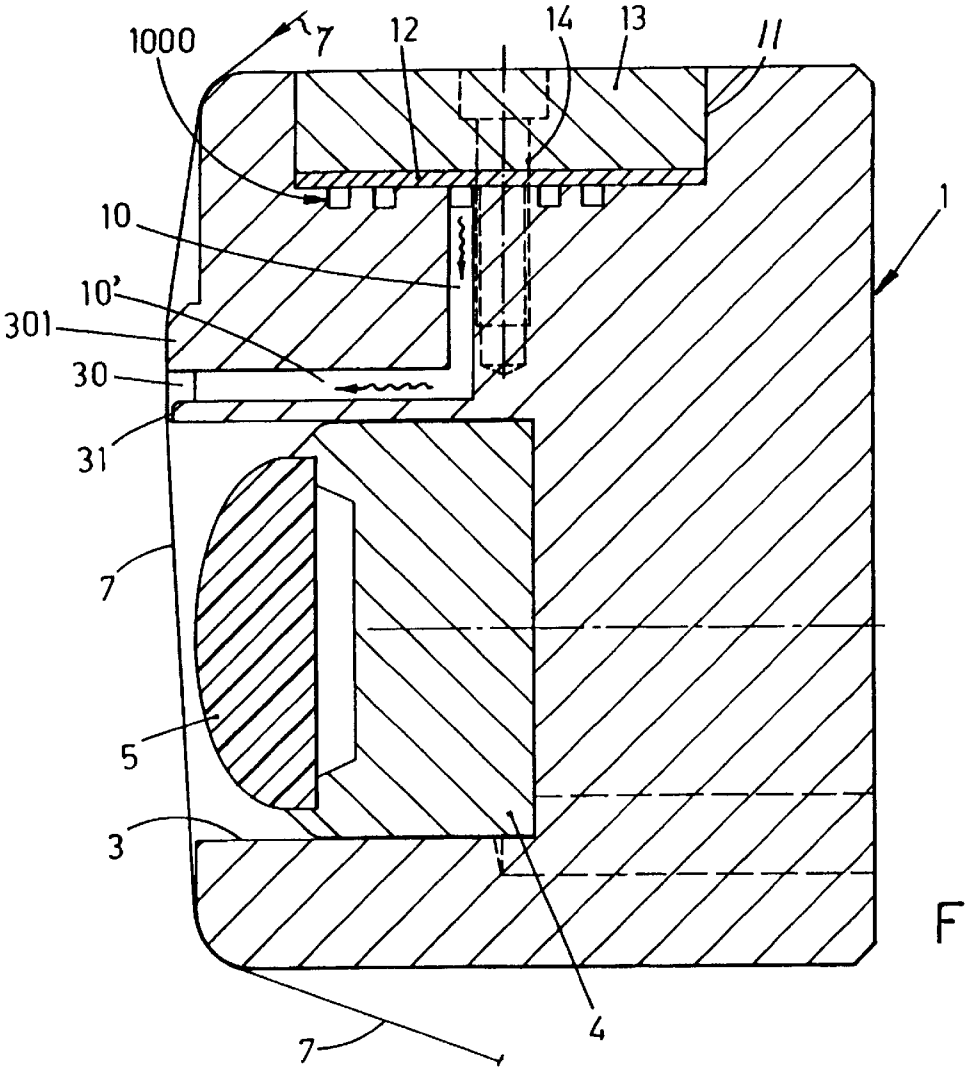

FIG. 5*a* shows a possible longitudinal section through a restriction of the circuit of FIG. 5, along the section line V—V;

FIGS. 6*a*, 6*b*, 6*c*, 6*d*, 6*e*, 6*f*, 6*g* and 6*h* show schematically eight different possible distributions of the restrictions in the circuit of the cleaning fluid mixture supply bar;

FIG. 7 shows details of the bar of FIG. 4, in cross section along the line VII—VII;

FIG. 8 shows a variant of the detail of FIG. 7.

Figure 3:
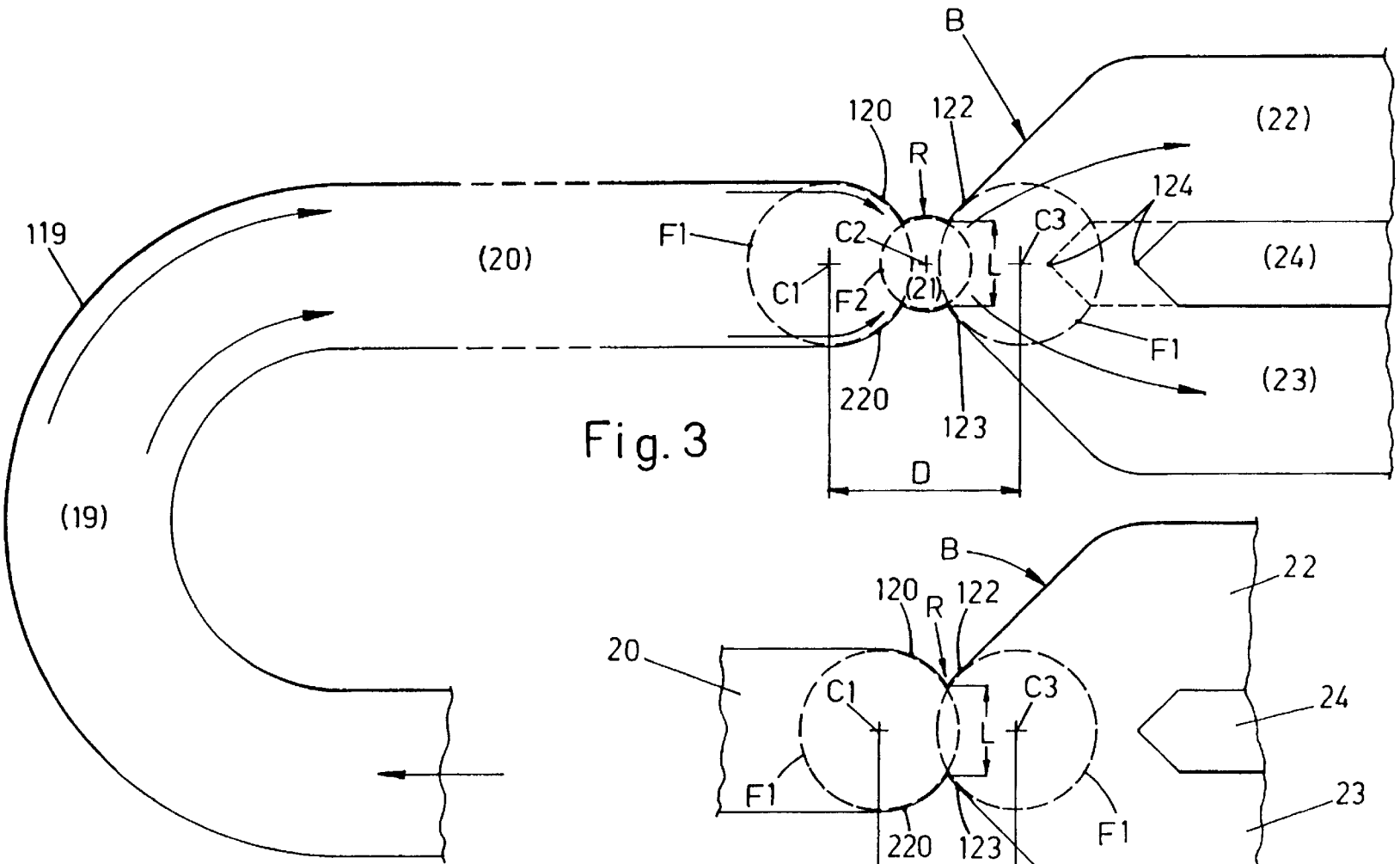

In FIG. 3, the number 19 indicates in a general way one of the curves of the fluid mixture transport circuit and 20 indicates the following rectilinear channel which then leads to a bifurcation B. According to the invention, a symmetrical restriction R of the section of the channel is provided upstream from each bifurcation B, preferably at the end of the channel 20, this restriction having the function of re-compacting the transported fluid mixture on the mid-line of the point of the bifurcation B, so that the mixture can subsequently be divided equally between the channels 22 and 23 following the said restriction. The restriction R also has the purpose of introducing into the mixture a vortical motion which contributes to the uniform dispersion of the liquid in the air flow and which therefore restores the mixture to the best condition for a balanced distribution at the next bifurcation.

In a first embodiment of the invention, which has yielded good results in practical terms, the restriction R consists of a chamber 21 with a cylindrical profile, formed by a cylindrical milling cutter F2 having a diameter appropriately smaller than the width of the fluid mixture transport channels 19, 20, and the centre C2 of the said chamber lies on the continuation of the longitudinal median axis of the channel 20. The fluid mixture transport channels are formed with a cylindrical milling cutter F1 and the end of the channel 20 is connected in the said chamber 21 to the curved lateral walls 120, 220 whose common centre of curvature C1 lies on the median axis of the channel 20.

The bifurcation B is formed in a symmetrical way, for example by means of a milling cutter F1 having the same diameter as that used to form the channel 20, and in this case the point 124 of the wall 24 dividing the channels 22, 23 is in the condition shown in solid lines. The aforesaid point 124 lies on the theoretical continuation of the longitudinal median axis of the channel 20. C3 indicates the centre of curvature of the initial part of the walls 122 and 123 of the channels 22 and 23 of the bifurcation B. By varying the distance D between the centres C1 and C3, it is possible to vary the size of one or both of the apertures L for communication with the chamber 21, and it is therefore possible to vary the restriction R formed by the assembly L-21, to adapt it to the different requirements of the circuit. It goes without saying that, in the initial part of the mixture transport circuit, the restrictions R can also be calibrated by an appropriate specification of the diameter of the chamber 21. All the fluid mixture transport channels, from the initial channel 100 of FIG. 2 to the most remote channels 108, 208 and 115, 215 of FIGS. 2 and 2*a*, can advantageously be formed with progressively decreasing sections which change only slightly from the start to the end (see below). It is also possible for all the bifurcations to be formed with the milling cutters F1 and F2 mentioned above with reference to FIG. 3, and the restrictions R will then progressively decrease in size towards the final outlet holes 10, to provide the compensation necessary to ensure that the cleaning fluid mixture leaves the said holes 10 in equal quantities and with equal compositions of air and liquid.

To prevent the development of progressive pressure drops in the circuit, which would obstruct the attainment of the objects in question, the sizes or cross sections of the various restrictions R of the cleaning fluid mixture transport circuit are calculated as a function of the sum of the sections of the holes 10 to which each restriction leads, the cross section of the restriction being preferably made greater than or approximately equal to the sum of the cross sections of the holes 10 to which the restrictions lead.

FIG. 5 shows, purely by way of example and without restriction, a possible design of the restrictions R of the bifurcations B2, B4, B5, B8, B9, B10, B11 of the part of the cleaning fluid mixture transport circuit, provided with eight outlet holes 10, shown in the example of FIG. 4.

If the holes 10 have, for example, a diameter of 0.8 mm and therefore a cross section of 0.5 $mm^2$, each of the restrictions R of the bifurcations B8–B11 is designed with a depth of 2 mm and with a width L of 0.63 mm and therefore with a cross section of 1.26 $mm^2$, approximately equal to or greater than the sum of the cross sections of the two holes 10 (1 $mm^2$) to which each of the said restrictions leads.

Each of the restrictions R of the bifurcations B4 and B5 leads to four holes 10, with a total cross section of 2 $mm^2$. These restrictions are designed, for example, with a width of 1 mm and with a depth of 2.5 mm and therefore with a cross section of 2.5 $mm^2$.

The restriction R of the bifurcation B2 leads to all of the eight holes 10, which have a total cross section of 4 $mm^2$. This restriction is designed, for example, with a depth of 3 mm and a width of 1.4 mm, and therefore with a cross section of 4.2 $mm^2$.

FIG. 5*a* shows how the depth of a restriction can be maintained throughout the following channel, up to a subsequent restriction where the decrease in depth begins, for example from the chamber 21. A step in the base 121 is therefore created upstream from the chamber 21, and this also contributes to the formation of the turbulence necessary for the homogenization and compacting of the mixture to be distributed.

Figure 1:
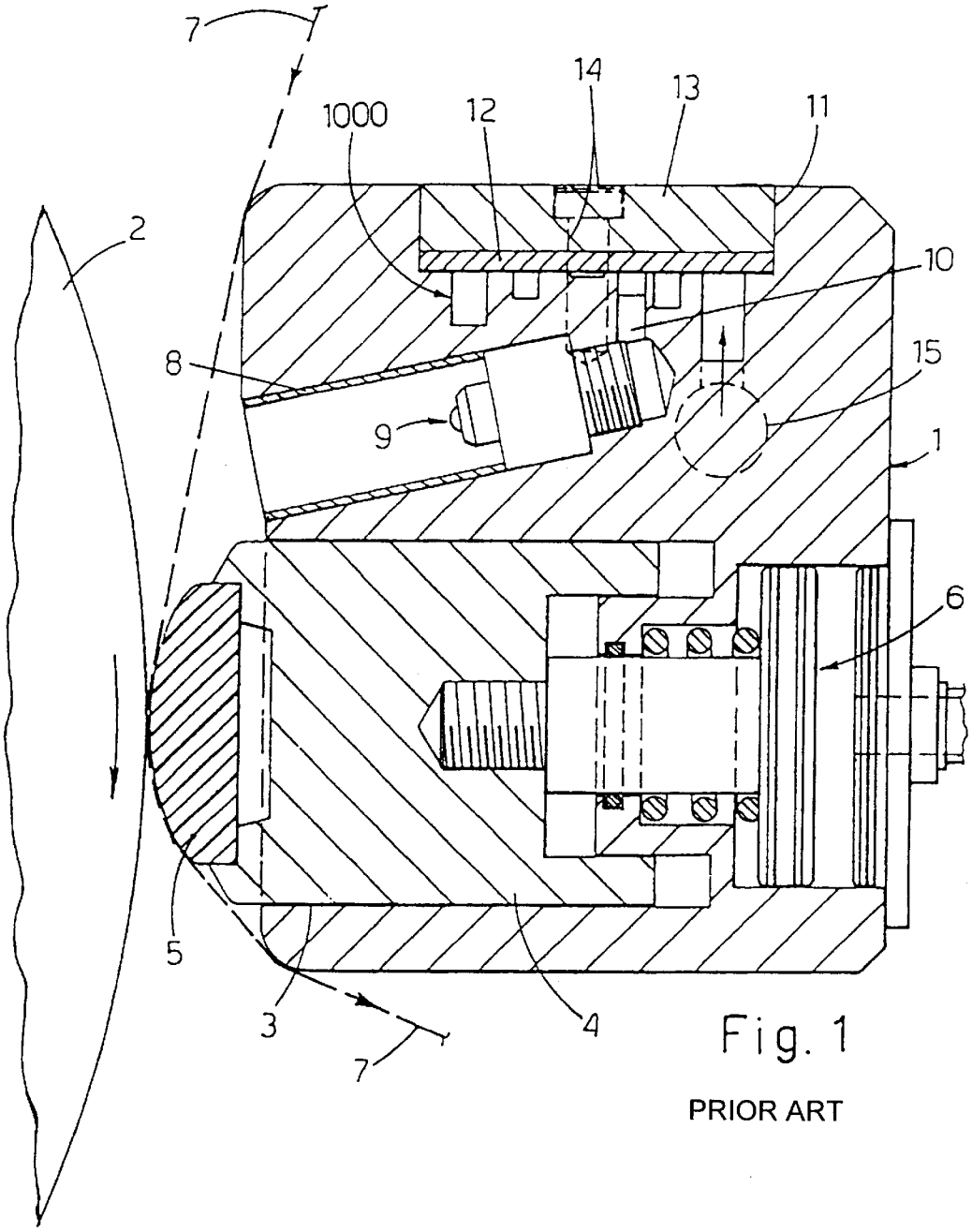
Fig. 1 PRIOR ART
Figure 2:
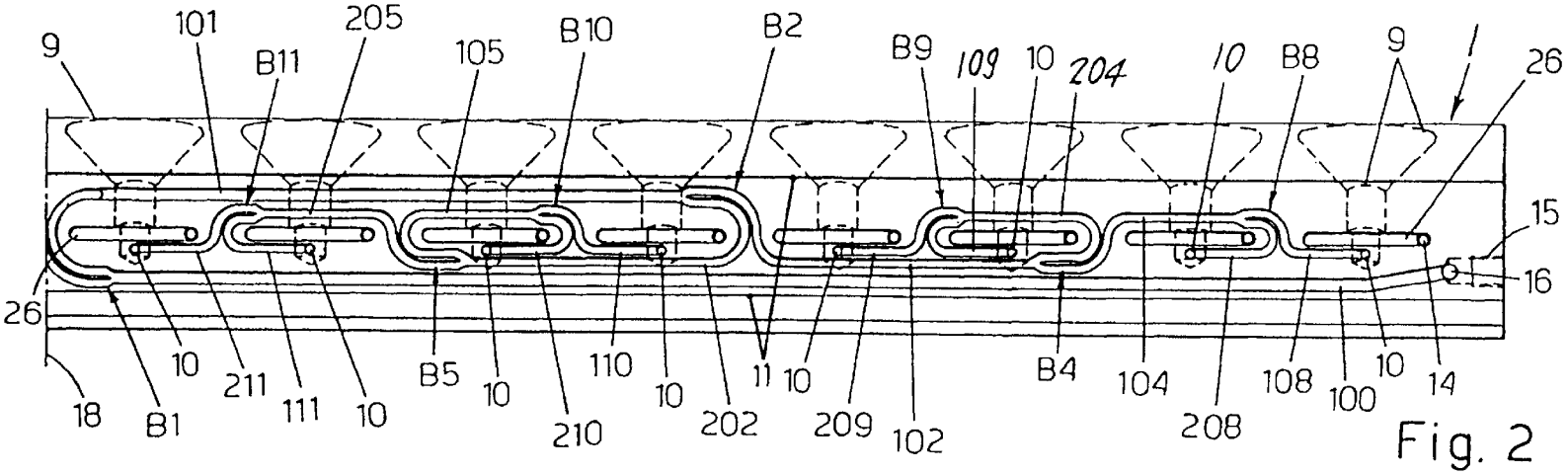
Fig. 2 PRIOR ART
Figure 2A:
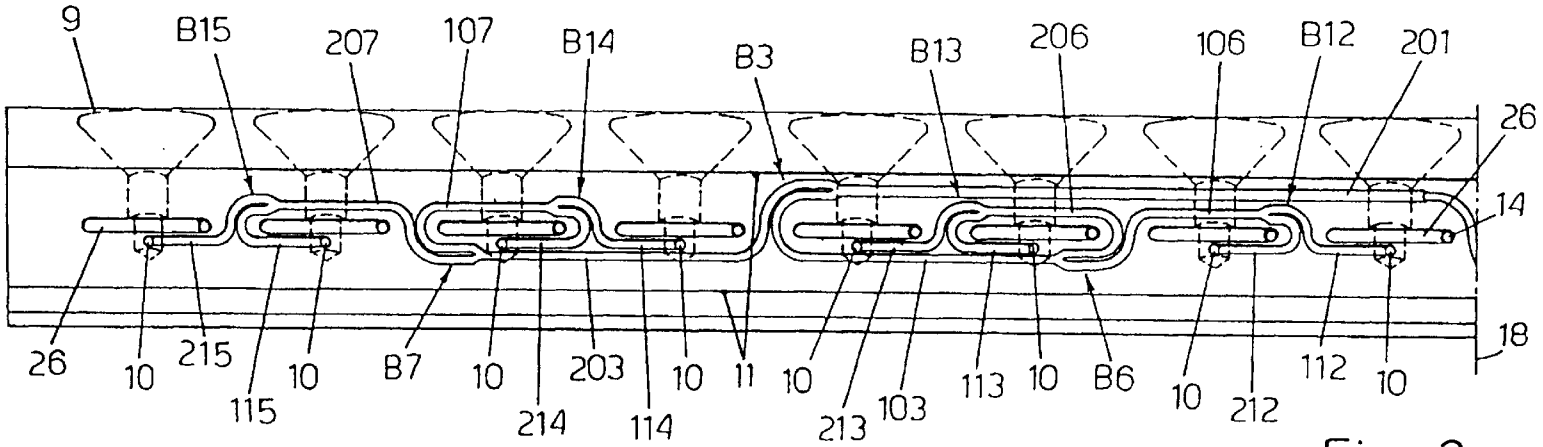
Fig. 2a PRIOR ART

FIG. 4 shows the fluid mixture transport circuit in a bar with a number of final outlet holes 10 equal to that of the circuit of FIGS. 2 and 2*a*. Each half bar, after the median bifurcation B1, comprises seven bifurcations indicated by B2, B4, B5, B8, B9, B10, B11, to supply a total of eight final holes 10. In addition to what has already been stated concerning the restrictions preceding the various bifurcations, it has been found that good results are obtained by making the channel supplying each bifurcation follow a rectilinear path which is aligned and sufficiently long, and by connecting this channel to the upstream bifurcation, with a right angle curve 320, such that vortices are induced in the fluid mixture with the effect of recomposing it and homogenizing it before it reaches the rectilinear resting channel which supplies the subsequent bifurcation.

A further improvement which is also an object of the invention consists in the possibility of eliminating the conventional nozzles 9 connected to the terminal holes 10 of the fluid mixture supply circuit, with economic advantages and with the following practical advantages. The passage cross section of the said nozzles, which is identical for all the nozzles, is usually smaller than the cross section of the holes 10, and therefore creates a true final restriction of the supply circuit, which has inevitable repercussions upstream of the division of the mixture at the final bifurcations. Following the realization of this fact, the front side of the bar 1 was modeled in such a way that, when the presser 4 was withdrawn (FIG. 7), the cloth 7 touched a projecting portion 301 of the front side of the bar, located immediately upstream of the recess 3 containing the presser, and a groove 30 was formed in this side parallel to the presser, this groove having a length such that it was covered by the cloth and having holes 10', continuing the final holes 10 of the fluid mixture supply circuit, opening into it. The groove 30 was also open towards the presser throughout its length or in portions lying between the final holes 10', thus providing an aperture 31 of suitable depth.

In the variant shown in FIG. 8, the groove 30' can have a limited depth and a height greater than the diameter of the terminal holes 10', and can be located centrally with respect to these holes 10'.

Figure 3A:
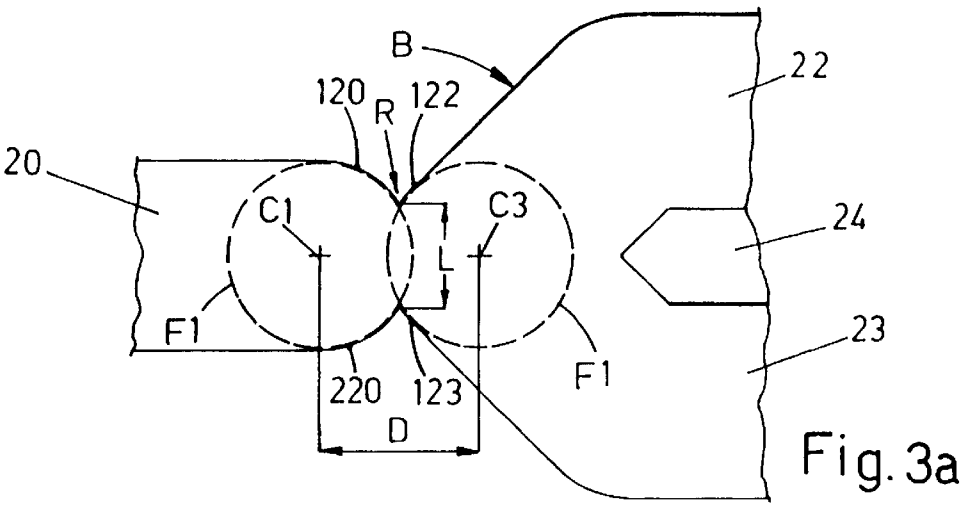

It goes without saying that the invention can be subjected to numerous variations and modifications, which may relate, for example, to the fact that the initial portion of the channels 22 and 23 of the bifurcation B can be made with the milling cutter F2 used to form the chamber 21, in such a way that the point 124 of the wall 24 is closer to the restriction R, as shown in broken lines in FIG. 3. Another variant may relate to the fact that the restriction R at each bifurcation B can be made in a different way, as shown in FIG. 3*a,* with the terminal converging part of the channel 20 connected directly to the initial diverging part of the said bifurcation B. and therefore with the elimination of the intermediate chamber 21. By varying the distance D between the axes C1 and C3, it will also be possible to vary the size of the aperture L of the restriction.

The restriction shown in FIGS. 3 and 3*a* is of a simple type and causes a slight turbulence upstream of the said restriction R.

Figure 3B:
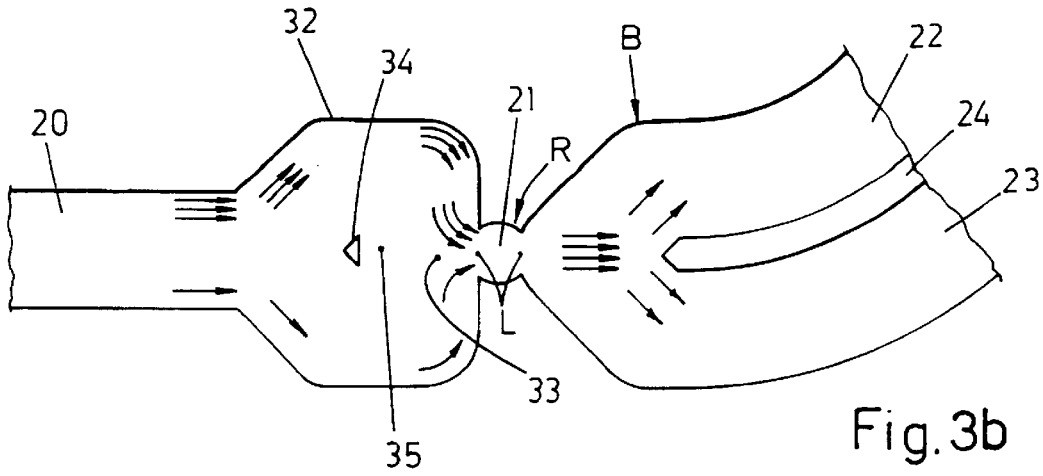

FIG. 3*b* shows a variant in which an enlargement 32 of constant width is provided upstream of the restriction R, and has the function of creating, in the median area 33 before the said restriction, a more marked turbulence than that created by the preceding solution.

Figure 3C:
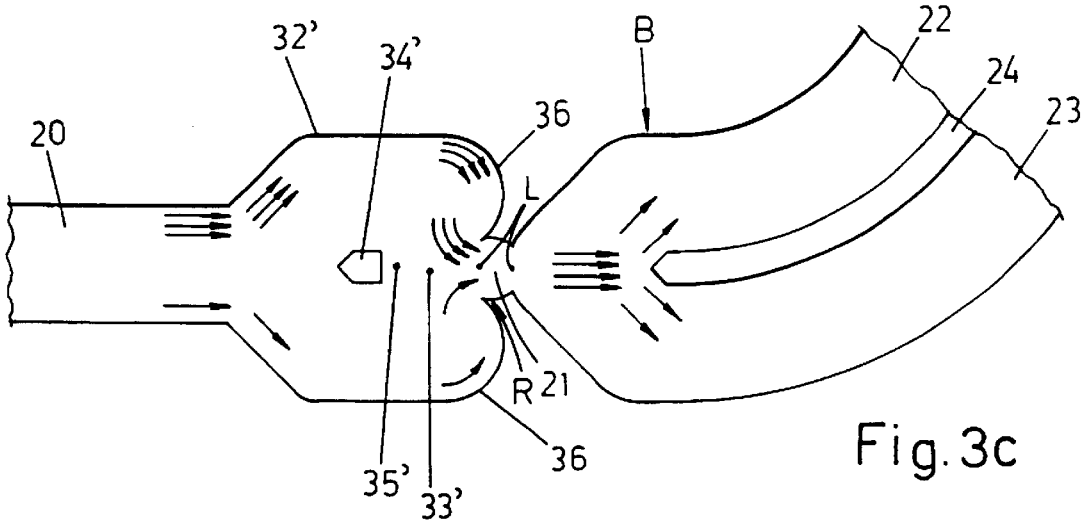
Figure 3D:
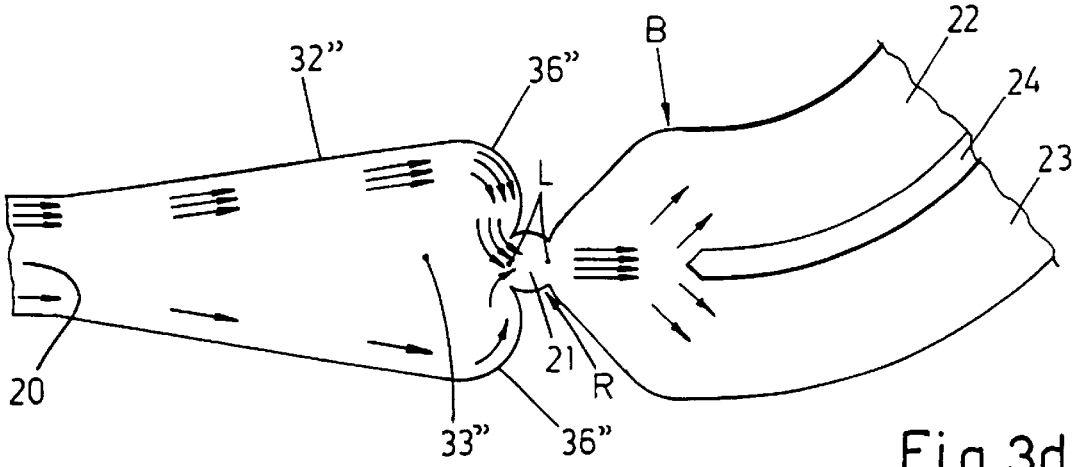

A prismatic projection 34 acting as a flow splitter can be provided in the centre of the enlargement 32. A low-pressure area 35 is created immediately downstream of this projection, and contributes to the return of the liquid component of the cleaning mixture to the mid-line. FIG. 3*c* shows a variant which differs from the solution of FIG. 3*b* in the presence of rounded symmetrical recesses 36 on the side of the enlargement 32' in which the restriction R opens, these cause a more marked turbulence of the mixture in the area 33'. The enlargement 32' according to this solution is of constant width and is provided in the centre with a flow splitter projection 34', in a similar way to the solution of FIG. 3*b*. FIG. 3*d* shows an alternative solution which differs from that of FIG. 3*c* in the absence of the flow splitter projection and in the use of an enlargement 32" having a shape which widens progressively towards the end recesses 36". This solution also creates a central area 33" of considerable turbulence before the restriction R.

Finally, FIGS. 6*a* to 6*h* show variants relating to the positioning of the restrictions R, which can also be provided immediately after each curve (FIGS. 6*a,* 6*e*) or along a rectilinear portion (FIGS. 6*b,* 6*f*–6*h*), or immediately after each bifurcation (FIGS. 6*c,* 6*g,* 6*h*) or a small distance before each bifurcation (6*d*). Finally, the variants in FIGS. 6*e*–6*h* show how, in addition to what has been stated above, two neighbouring restrictions can lead into three channels instead of four.

What is claimed is:

1. A bar for supplying a fluid mixture of pressurized air and detergent liquid in equipment for cleaning rubber-coated cylinders and inking rollers of printing machines, said bar comprising:

an elonaate flat side;

a plurality of mixture supply holes distributed uniformly along a length of said flat side;

a branching supply circuit by which the fluid mixture is successively divided and ultimately delivered in equal parts to respective said supply holes, said branching supply circuit including a) channels formed on said flat side said channels including a first delivery channel to which the fluid mixture is introduced, respective associated downstream delivery channels into which the then divided fluid mixtures from said first delivery channel or from a said downstream delivery channel upstream therefrom are respectively delivered, said downstream delivery channels including final delivery channels by which respective equal parts of the fluid mixture are respectively finally delivered to a respective said mixture supply hole, respective Y-shaped bifurcations which connect said first delivery channel and said downstream delivery channels to one another and which perform the successive divisions of the fluid mixture, and a respective restriction provided at a downstream end of each respective said delivery channel which is upstream from an associated said Y-shaped bifurcation, each said restriction being shaped to guide the fluid mixture in the delivery channel to a mid-line of a point of the associated said Y-shaped bifurcation and to induce a formation of a vortex of the fluid mixture which homogenizes the fluid mixture, so that the fluid mixture is distributed with equal proportions of air and liquid in both split delivery channels from the associated said Y-shaped bifurcation;

b) a flat seal which covers said channels; and c) a cover plate which caps said flat seal, thus converting said channels into closed ducts.

2. A bar according to claim 1:

wherein the delivery channels have respective cross sections such that a quantity of air required for transport and spraying of the detergent liquid reaches all said supply holes, and wherein said restrictions have cross sections decreasing progressively from a first Y-shaped bifurcation at an end of said first delivery channel, such that the fluid mixture of air and liquid reaches said supply holes with essentially identical pressure characteristics.

3. A bar according to the claim 1, wherein a cross section of each said restriction is approximately equal to or greater than a sum of those cross sections of said supply holes downstream thereof.

4. A bar according to claim 2, wherein a width and/or a depth of the delivery channels remain constant throughout a long portions thereof up to the associated said restriction.

5. A bar according to claim 2, wherein a width and/or a depth of the delivery channels decreases progressively in an initial portion thereof and remains constant throughout long portions of said delivery channels up to the associated said restriction.

6. A bar according to claim 2, wherein a width and/or a depth of the delivery channels decrease progressively from a start thereof to the associated said restriction.

7. A bar according to claim 6, wherein the depth of the delivery channels changes at each successive said restriction by providing a step formed in each said delivery channel at the associated said restriction, which said step contributes to the formation of the vortex which compacts and homogenizes the fluid mixture distributed into the delivery channels following each said Y-shaped bifurcation.

8. A bar according to claim 1, wherein each said restriction comprises a symmetrical restriction of a width of the respective said delivery channel upstream therefrom.

9. A bar according to claim 1, wherein each said restriction comprises an asymmetrical restriction of a height of the respective said delivery channel upstream therefrom.

10. A bar according to claim 1, wherein each said restriction comprises a symmetrical restriction of a width and an asymmetrical restriction of a height of the respective said delivery channel upstream therefrom.

11. A bar according to claim 1, wherein each said restriction is formed by an intersection of (a) a terminal part of the delivery channel which has converging walls rounded about a first axis, and (b) an initial part of the associated said Y-shaped bifurcation which has diverging walls partially curved about a second axis, such that a size or cross section of each said restriction can be varied by varying a distance between the first and second axes.

12. A bar according to claim 1, wherein each said restriction is formed by an intersection of (a) a terminal part of the delivery channel which has walls rounded about a first axis, and (b) an initial part of the associated said Y-shaped bifurcation which has diverging walls partially curved about a second axis, with an intermediate cylindrical chamber whose central axis lies on a continuation of a longitudinal median axis of the associated said delivery channel, said chamber being formed with a diameter which is smaller than a diameter of the rounded wall of the associated said delivery channel.

13. A bar according to claim 12, wherein, in each said restriction, the cylindrical chamber is connected to the delivery channel and to the Y-shaped bifurcation by restricting apertures of equal or different sizes.

14. A bar according to claim 1, wherein an initial part of each said Y-shaped bifurcation is formed by said split delivery channels branching from said Y-shaped bifurcation.

15. A bar according to claim 1:

wherein each said restriction includes a cylindrical chamber;

wherein an initial part of each said Y-shaped bifurcation is made by an intersection with the associated said cylindrical chamber; and wherein said Y-shaped bifurcation includes a dividing wall located between the split delivery channels, and said dividing wall has a frontal point located in a position nearer to the associated said restriction than a width of said downstream channels.

16. A bar according to claim 1, further including a symmetrical enlargement of each said delivery channel provided upstream of each associated said restriction, in order to provide a more effective turbulence and a more effective compacting and homogenization of the fluid mixture flowing towards the associated said restriction.

17. A bar according to the claim 1:

wherein the delivery channel for each said Y-shaped bifurcation has a rectilinear shape and has a terminal length thereof which defines a median axis;

wherein each said restriction is formed by an intersection of (a) a terminal part of the delivery channel which has walls rounded about a first axis, and (b) an initial part of the associated said Y-shaped bifurcation which has diverging walls partially curved about a second axis, with an intermediate cylindrical chamber having a central axis; and wherein the first axis, the second axis and the central axis all lie on a continuation of the median axis.

18. A bar according to claim 1, wherein each delivery channel located between associated said Y-shaped bifurcations includes a ninety-degree curve with suitably rounded corner areas.

19. A bar according to the claim 1:

wherein each said mixture supply holes has a proximal portion which is perpendicular to an associated and adjacent said delivery channel, and a distal portion which is at ninety degrees to said proximal portion;

further including (a) an elongate cleaning side which faces the cylinder to be cleaned, said cleaning side having a longitudinal projecting part on which a cleaning cloth slides when no cleaning is taking place, and (b) a rectilinear groove provided longitudinally in said cleaning side adjacent said projecting part such that the cloth runs along a length of said groove and the distal portions of said mixture supply holes open into the groove, and such that the fluid mixture discharged from the various distal portions of said mixture supply holes enters said groove in a uniform way and comes in contact with the cloth in a uniform way and over a whole length of the cloth.

20. A bar according to claim 19:

wherein diameters of the proximal portions of said supply holes are greater than widths of the delivery channels associated therewith;

wherein diameters of the distal portions of said supply holes are greater than the diameters of the proximal portions of said supply holes; and wherein a width of the rectangular groove to which the distal portions of said supply holes are connected is equal to or greater than the diameters of the distal portions of said supply holes.

21. A bar according to claim 20, wherein the groove has a depth and a width which are equal to each other, and has an aperture having a small depth on a side thereof opposite to said projecting part.

22. A bar according to claim 20, wherein the groove has a limited depth, and has a height such that said groove projects both upstream and downstream of the distal portions of the supply holes.

23. A bar according to claim 16, further including a flow splitter in a center of each said symmetrical enlargement of said delivery channels.

* * * * *